US005922500A

United States Patent [19]

Iida et al.

[11] Patent Number: 5,922,500

[45] Date of Patent: Jul. 13, 1999

[54] TONER FOR DEVELOPING ELECTROSTATIC IMAGE

[75] Inventors: Wakashi Iida, Numazu; Makoto Kanbayashi, Shizuoka-ken, both of Japan

[73] Assignee: Canon Kabushiki Kaisha, Tokyo, Japan

[21] Appl. No.: 08/972,177

[22] Filed: Nov. 19, 1997

[30] Foreign Application Priority Data

Nov. 19, 1996 [JP] Japan ..... 8-307713

[51] Int. Cl.[6] ..... G03G 9/097

[52] U.S. Cl. ..... 430/110; 428/405

[58] Field of Search ..... 430/110; 428/405

[56] References Cited

U.S. PATENT DOCUMENTS

| | | | |
|---|---|---|---|
| 2,297,691 | 10/1942 | Carlson | 95/5 |
| 2,618,552 | 11/1952 | Wise | 95/1.9 |
| 4,904,558 | 2/1990 | Nagatsuka et al. | 430/122 |
| 5,192,637 | 3/1993 | Saito et al. | 430/109 |
| 5,437,949 | 8/1995 | Kanbayashi et al. | 430/45 |
| 5,512,402 | 4/1996 | Okado et al. | 430/106.6 |
| 5,607,806 | 3/1997 | Kanbayashi et al. | 430/110 |
| 5,635,326 | 6/1997 | Kanbayashi et al. | 430/110 |
| 5,698,357 | 12/1997 | Inoue et al. | 430/110 |

FOREIGN PATENT DOCUMENTS

| | | |
|---|---|---|
| 0523654 | 12/1980 | European Pat. Off. . |
| 0674236 | 9/1995 | European Pat. Off. . |
| 52-32256 | 8/1977 | Japan . |
| 56-64352 | 6/1981 | Japan . |
| 60-112052 | 6/1985 | Japan . |
| 61-160760 | 7/1986 | Japan . |
| 42-23910 | 3/1987 | Japan . |
| 43-24748 | 6/1989 | Japan . |
| 5-72797 | 3/1993 | Japan . |
| 5-188633 | 7/1993 | Japan . |
| 6-332232 | 12/1994 | Japan . |

OTHER PUBLICATIONS

Suzuki, "Tone Reproduction Technology of Electrophotography", J. Electrophotographic Society, vol. 25, No. 1, pp. 52–58 (1986).

Aoki, et al., "Color Reproduction of PPC Color Copier," J. Electrophotographic Soc., vol. 22, No. 1, pp. 7–16 (1983).

*Primary Examiner*—John Goodrow
*Attorney, Agent, or Firm*—Fitzpatrick, Cella, Harper & Scinto

[57] ABSTRACT

A toner for developing an electrostatic image is disclosed which has toner particles and hydrophobic fine titanium oxide particles. The hydrophobic fine titanium oxide particles have, in X-ray diffraction, an intensity ration Ia/Ib of $5.0 \leqq Ia/Ib \leqq 12.0$ which is a ratio of maximum intensity Ia to minimum intensity Ib within the range of $2\theta = 20.0$ to 40.0 deg.

30 Claims, 3 Drawing Sheets

TONER FOR DEVELOPING ELECTROSTATIC IMAGE

BACKGROUND OF THE INVENTION

1. Field of the Invention

This invention relates to a dry-process toner for developing an electrostatic image in image forming processes such as electrophotography, electrostatic recording and electrostatic printing.

2. Related Background Art

It is conventionally known to form an image on the surface of a photoconductive material by an electrostatic means, and develop it by the use of a toner.

A large number of methods are known as electrophotography, as disclosed in U.S. Pat. No. 2,297,691, Japanese Patent Publications No. 42-23910 and No. 43-24748 and so forth. In general, an electrostatic image is formed on a photosensitive member, utilizing a photoconductive material and according to various means, and subsequently a toner is caused to adhere to the electrostatic image to form a toner image.

Next, the toner image is transferred to the surface of an image holding medium such as paper if necessary, followed by fixing by the action of heat, pressure, heat-and-pressure, or solvent vapor. A copy or print is thus obtained. In the case when the process comprises a toner-image transfer step, the process is usually provided with a cleaning step for removing the toner remaining on the photosensitive member.

As developing methods by which the electrostatic latent image is developed by the use of a toner, known methods can be exemplified by the powder cloud development as disclosed in U.S. Pat. No. 2,221,776, the cascade development as disclosed in U.S. Pat. No. 2,618,552, the magnetic brush development as disclosed in U.S. Pat. No. 2,874,063, and the method in which a conductive magnetic toner is used, as disclosed in U.S. Pat. No. 3,909,258.

As toners used in these developing methods, colorant-containing resin particles (toner particles) are commonly used which are prepared by melt-kneading a thermoplastic resin and a colorant, thereafter cooling the kneaded product obtained and finely pulverizing the cooled kneaded product. The thermoplastic resin most commonly includes polystyrene resins. Besides, polyester resins, epoxy resins and acrylic resins are also used. As a non-magnetic colorant, carbon black is widely used. In the case of magnetic toners, black magnetic powders of an iron oxide type are used. In a system in which a two-component type developer is used, the toner is usually used admixture with carrier particles such as iron powder and ferrite powder or resin-coated carriers of these.

The toner image finally formed on an image holding medium such as paper is fixed onto the image holding medium by the action of heat, pressure, or heat-and-pressure. In this fixing step, the step of fixing by a heating pressure means has been conventionally widely used.

In recent years, rapid progress is being made from monochromatic copying or monochromatic printing to full-color copying or full-color printing, and research has been conducted on two-color copying machines or full-color copying machines, which have been widely put into practical use. For example, Journal of Electrophotographic Society, Vol. 22, No. 1 (1983) and Journal of Electrophotographic Society, Vol. 25, No. 1, p.52 (1986) have published reports relating to color reproducibility and gradation reproducibility.

In color image formation carried out by full-color electrophotography, three color toners of the three primary colors, yellow, magenta and cyan are commonly used optionally together with a black toner to reproduce all colors.

The full-color copying process comprises the steps of forming an electrostatic image on a photoconductive layer by passing light reflected from an original, through a color-separating light-transmitting filter having the relation of complementary color to the color of a toner, followed by developing and transfer, through which a color toner image is held on an image holding medium. These steps are repeated several times to superimpose toner images of respective colors on the same medium while making registration, followed by fixing carried out once to obtain a final full-color image.

In general, in the case of a development system making use of a two-component developer comprised of a toner and a carrier, the toner is electrostatically charged to the desired charge quantity and charge polarity by its friction with the carrier, and the electrostatic attraction force produced is utilized to develop electrostatic images by the use of a toner having triboelectric charges. Accordingly, in order to obtain good visible images, the triboelectric chargeability of toner must be maintained at a good level.

Presently, to meet such problems, charge control agents and fluidity-providing agents employed in toners and binders serving as a toner matrix are selected to achieve superior triboelectric chargeability for developers containing them.

For example, to add a charging auxiliary such as chargeable fine particles to the toner, Japanese Patent Publication No. 52-32256 and Japanese Patent Application Laid-Open No. 56-64352 disclose a technique of adding a resin powder having a polarity reverse to the toner, and Japanese Patent Application Laid-Open No. 61-160760 discloses a technique of adding a fluorine-containing compound to developers so as to achieve a stable triboelectric chargeability.

To add such a charging auxiliary, for example, it is common to use a method in which electrostatic attraction force or van der Waals force, acting between toner particles and the charging auxiliary, is utilized to cause the latter to adhere to the toner particle surfaces by using a stirrer or a mixer. In such a method, however, it is not easy to uniformly disperse the charging auxiliary on the toner particle surfaces. Charging auxiliary particles not adhering to toner particles may form agglomerates, tending to result in an increase in the quantity of agglomerates brought into a free state, as liberating from toner particles. This tends to more significantly occur with an increase in specific electrical resistance of the charging auxiliary and with a decrease in particle diameter. Where the free agglomerates are present in a large quantity, they may influence toner performance therefrom. For example, the toner, may have an unstable amount of triboelectricity at the time of extented copying, tending to result in non-uniform image densities and formation of images with much fog.

In addition, the content of the charging auxiliary changes when copies are continuously taken, to make it difficult to keep image quality at the initial stage.

There is a method in which a charge control agent is previously added together with a binder resin and a colorant when toners are produced. However, the amount of the charge control agent added or the amount of its presence on the toner particle surfaces can not be controlled with ease because it is not easy to uniformly disperse the charge control agent in the binder resin and also because what substantially contributes to charging performance are those charge control agents present in the vicinity of toner particle surfaces and those present inside the particles do not contribute to the charging performance.

It is proposed to externally add fine titanium oxide particles to toner particles to impart fluidity to the toner and stabilize charging.

Since, however, as disclosed in Japanese Patent Application Laid-Open No. 60-112052, an anatase type titanium oxide having a low volume resistivity is used, triboelectric charges may leak quickly especially in an environment of high humidity, improvements have had to be made especially in respect of stabilization of charging. In addition, the anatase type titanium oxide has, in the X-ray diffraction described later, an intensity ratio Ia/Ib larger than 12.0 which is a ratio of maximum intensity Ia to minimum intensity Ib within the range of $2\theta$=20.0 to 40.0 deg.

Japanese Patent Application Laid-Open No. 5-72797 (corresponding to EP-A-523654) discloses a proposal relating to a toner containing a hydrophobic amorphous titanium oxide. Since, however, the amorphous titanium oxide has lower abrasive properties than crystalline titanium oxide, an improvement has had to be made with respect to the member abrasion of photosensitive member surface and removal of deposits on the photosensitive member surface. Since the amorphous titanium oxide also has many OH groups even after hydrophobic treatment, an improvement has had to be made in respect of charging performance which may become reduced because of adsorption of water content especially in an environment of high humidity. The amorphous titanium oxide has an intensity ratio Ia/Ib smaller than 5.0.

Japanese Patent Application Laid-Open No. 6-332232 also discloses a proposal to add an acicular or needle-like titanium oxide with a large major axis particle diameter. However, the toner has a low fluidity which is greatly affected by the acicular shape and large major axis particle diameter of the titanium oxide. This acicular titanium oxide has an intensity ratio Ia/Ib exceeding 12.0.

Japanese Patent Application Laid-Open No. 6-332233 also discloses a proposal relating to a toner to the particle surfaces of which titanium oxide particles represented by $TiO_x$ (x is less than 2) are deposited. These titanium oxide particles, however, are black or blue and are unsuitable as an external additive for a color toner such as yellow toner or magenta toner. Also, because of their relatively large particle diameter, they have a low performance in imparting fluidity to toner and also tend to scratch the photosensitive drum surface. The $TiO_x$ where x is less than 2 commonly has an intensity ratio Ia/Ib larger than 12.0.

Japanese Patent Application Laid-Open No. 5-188633 also discloses a proposal relating to a toner containing a fine powder of hydrophobic-treated anatase type titanium oxide. Since this titanium oxide has perfect anatase crystals, titanium oxide particles may mutually agglomerate in part to scratch the photosensitive drum surface, or, when externally added to small-diameter toner particles, the toner may have a low fluidity. This anatase type titanium oxide has an intensity ratio Ia/Ib larger than 12.0.

Some titanium oxides are known to have rutile type crystals, which, however, have a small BET specific surface area. Their crystals have grown in an acicular or columnar shape, and hence may impart fluidity and abrasive properties at an undesirably low level.

It is eagerly awaited to develop titanium oxide particles providing more improvements in sufficient fluidity, charging performance, abrasive properties, environmental stability and running performance for toners.

Moreover, in recent years, there is an increasing commercial demand for making copying machines or printers achieve a higher resolutior and making images have a higher quality. In the present technical field, it has been attempted to make toner particle diameter smaller so that a color image can be formed in a higher image quality. Making smaller the particle diameters of toner particles results in an increase in the surface area per unit weight, tending to bring about an excessively large quantity of triboelectricity of the toner. This tends to cause an insufficiency of image density or a deterioration of running performance of the toner. In addition, because of the large quantity of triboelectricity, toner particles may strongly adhere to one another to cause a decrease in fluidity, bringing about a problem in the stability of toner feed and the imparting feed triboelectricity to the toner feed.

In the case of non-magnetic color toners, they contain no conductive materials such as magnetic materials and carbon black, and hence the toner particles have no portions from which triboelectric charges are leaked, and typically tend to have a larger quantity of triboelectricity of the toner. This tends to occur especially when polyester type binders having a high charging performance are used.

Color toners are desired to satisfy performances as shown below.

(1) Fixed toners are required to nearly form into a substantially completely molten state to the extent that the forms of toner particles can not be recognized, so as not to obstruct their color reproduction because of irregular reflection upon exposure to light.

(2) Color toners must have a transparency high enough to perform subtractive color mixing well with an underlying toner layer having a color tone different from its upper toner layer.

(3) The respective color toners must have well-balanced hues and spectral reflection properties, and sufficient chroma.

From such viewpoints, resins of a polyester type are widely used as binder resins for color toners used to form full-color images. Toners comprised of polyester resin as binder resin, however, commonly tend to be affected by temperature and/or humidity, and tend to cause problems of an excessive charge quantity in an environment of low humidity and an insufficient charge quantity in an environment of high humidity. Thus, it is eagerly awaited to provide color toners having stabler charging performance even in a wide range of environment.

SUMMARY OF THE INVENTION

An object of the present invention is to provide a dry-process toner for developing an electrostatic image, having solved the problems discussed above.

Another object of the present invention is to provide a toner for developing an electrostatic image, that can form fog-free sharp images, can achieve a high image density, superior fine-line reproducibility and high-light area gradation and also has a superior running performance stability.

Still another object of the present invention is to provide a toner for developing an electrostatic image, that has superior fluidity and can achieve superior resolution and transfer property.

A further object of the present invention is to provide a toner for developing an electrostatic image, that can abrade or remove any deposits on the photosensitive member surface which are caused by long-term service, or prevent such deposits from occurring, and can obtain faulty-image-free and stable images over a long period of time.

A still further object of the present invention is to provide a toner for developing an electrostatic image, that may be hardly influenced by environmental factors such as temperature and/or humidity and has a stable triboelectric charging performance.

A still further object of the present invention is to provide a toner for developing an electrostatic image, having a superior fixing performance and also a superior OHP transmission.

A still further object of the present invention is to provide a dry-process color toner for developing an electrostatic image, suited for forming full-color images or multi-color images.

To achieve the above objects, the present invention provides a toner for developing an electrostatic image, comprising toner particles and hydrophobic fine titanium oxide particles, wherein;

the hydrophobic fine titanium oxide particles have, in X-ray diffraction, an intensity ratio Ia/Ib of $5.0 \leqq Ia/Ib \leqq 12.0$ which is a ratio of maximum intensity Ia to minimum intensity Ib within the range of $2\theta=20.0$ to 40.0 deg.

DESCRIPTION OF THE PREFERRED EMBODIMENTS

Figure 1:
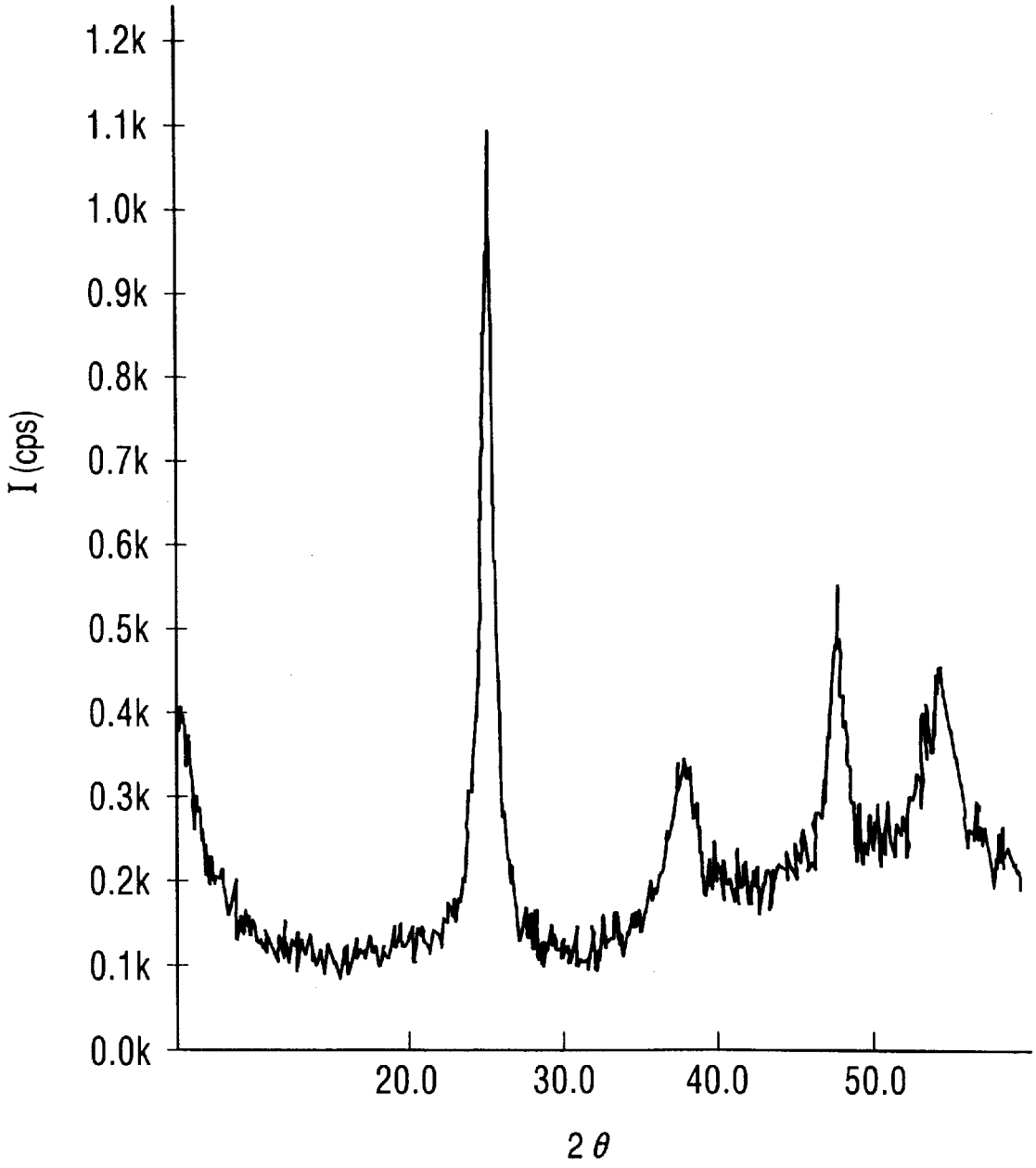
FIG. 1 shows an example of a chart of X-ray diffraction of the fine titanium oxide particles used in the present invention.

The toner of the present invention contains hydrophobic fine titanium oxide particles having, in X-ray diffraction, an intensity ratio Ia/Ib of $5.0 \leqq Ia/Ib \leqq 12.0$ which is a ratio of maximum intensity Ia to minimum intensity Ib within the range of $2\theta=20.0$ to 40.0 deg.

The intensity ratio Ia/Ib within $2\theta=20.0$ to 40.0 deg in X-ray diffraction is concerned with the crystal form of fine titanium oxide particles and the performances to impart fluidity and abrasive properties to toner.

An instance where the ratio Ia/Ib is smaller than 5.0 indicates that the fine titanium oxide particles have, in the X-ray diffraction, no clear peak relating to crystal structure, and are non-crystalline. Such fine titanium oxide particles have a lower performance to impart abrasive properties to toner than titanium oxides having clear peak in the X-ray diffraction. Hence, such titanium oxide particles have low performances to abrade the photosensitive member surface and to remove deposits on the photosensitive member surface.

Fine titanium oxide particles having an intensity ratio Ia/Ib less than 5.0 have undergone no crystal growth at all, and hence are soft as particles. Accordingly, even if they are fine particles with a number average particle diameter of from 1 to 100 nm, it is considered that the performance to impart abrasive properties to toner lowers.

If the intensity ratio Ia/Ib is larger than 12.0, particles having coalesced tend to occur in the fine titanium oxide particles in the course of enhancing crystallinity, so that the performance to impart fluidity to toner may lower to tend to cause filming on the photosensitive member surface or damage the photosensitive member surface. Also, when the hydrophobic treatment is conducted, the particles having coalesced can be a factor of inhibiting uniform reaction with a hydrophobicizing agent, undesirably.

Within $2\theta=20.0$ to 40.0 deg in the X-ray diffraction of the hydrophobic fine titanium oxide particles, the maximum intensity Ia may preferably be present at $2\theta=24.0$ to 26.0 deg and the minimum intensity Ib at $2\theta=28.0$ to 33.0 deg.

This indicates that the fine titanium oxide particles are under course of crystal growth from amorphous to anatase type or that an amorphous portion and an anatase type crystal portion are mixedly present.

There are no particular limitations on the starting materials and production process for the fine titanium oxide particles. However, as a result of extensive studies made on the fluidity-providing performance, charging performance and charging stability of the fine titanium oxide particles, it has been found to be effective to use fine titanium oxide particles which are under course of the transition of crystal form from amorphous type to anatase type or fine titanium oxide particles in which an amorphous portion and an anatase type crystal portion are mixedly present, both of which titanium oxide contain a proper quantity of OH groups acting as reactive sites with hydrophobicizing agents.

Production examples for the hydrophobic fine titanium oxide particles used in the present invention will be described below.

(a) Using ilmenite as a starting material, and decomposing it with sulfuric acid to obtain a dispersion which is then hydrolyzed to form a metatitanic acid slurry. After adjustment of the pH of this metatitanic acid slurry, metatitanic acid particles are well dispersed in an aqueous medium so as not to cause their coalescence in the slurry, during which a hydrophobicizing agent is dropwise added and mixed to carry out reaction. The resultant reaction product is filtered, followed by drying and disintegration to form hydrophobic fine titanium oxide particles.

(b) Titanium tetraisopropoxide is used as a material. Using nitrogen gas as a carrier gas, the material is fed very little by little into glass wool of a vaporizer heated to about 200° C., by means of a chemical pump and is evaporated, which material is then instantaneously heated and decomposed at about 300° C. in the reaction vessel, followed by rapid cooling, and the product formed is collected. This product is further fired at about 300° C. for about 2 hours to control its intensity ratio Ia/Ib, and is further made hydrophobic to form hydrophobic fine titanium oxide particles.

The hydrophobic fine titanium oxide particles may preferably have a BET specific surface area in the range of from 100 to 350 $m^2/g$.

An instance where the hydrophobic fine titanium oxide particles have a BET specific surface area smaller than 100 $m^2/g$ indicates that the hydrophobic fine titanium oxide particles have a large particle diameter and agglomerates or coarse particles of titanium oxide are present, tending to cause the problems that the fluidity of toner may lower, the photosensitive member surface may be scratched, the cleaning means such as a cleaning blade may be deformed or damaged. Also, hydrophobic fine titanium oxide particles with a large particle diameter tend to become liberated from toner particles, and the hydrophobic fine titanium oxide particles thus liberated may remain in the developing assembly in a large quantity or may adhere to various assemblies inside the main body of the image forming apparatus to have a bad influence, undesirably.

If the hydrophobic fine titanium oxide particles have a BET specific surface area larger than 350 $m^2/g$, water may adsorb on the hydrophobic fine titanium oxide particles in so large a quantity that they may adversely affect the charging performance of toner. Especially in an environment of high humidity, the quantity of triboelectricity of toner may lower to tend to cause toner scatter, fog and image deterioration.

The hydrophobic fine titanium oxide particles may preferably have a number average particle diameter of from 1 to 100 nm in view of the providing of fluidity and abrasive properties to toner. If the hydrophobic fine titanium oxide particles have a number average particle diameter smaller than 1 nm, they tend to become buried in toner particle surfaces to tend to cause early deterioration of toner to cause a lowering of running performance and also result in low abrasive properties of the hydrophobic fine titanium oxide particles.

If on the other hand the hydrophobic fine titanium oxide particles have a number average particle diameter larger than 100 nm, the fluidity of toner may lower to tend to cause non-uniform charging, and consequently the image deterioration, toner scatter and fog tend to occur. Also, the photosensitive member surface may be greatly scratched to tend to cause faulty images, also tending to bring about the problem that the cleaning means such as a cleaning blade may be deformed or damaged.

With regard to the abrasion of the photosensitive member surface and the removal of deposits therefrom, the toner temporarily stagnates at the pressure contact zone between the photosensitive member surface and the cleaning means such as a cleaning blade when it is removed from the photosensitive member surface by cleaning. The hydrophobic fine titanium oxide particles present on the surfaces of the toner particles stagnating there carry out the function to abrade the photosensitive member surface and remove the deposits thereon. However, the hydrophobic fine titanium oxide particles may preferably be dispersed in the toner in a state free of agglomerates and close to primary particle diameter particles and also uniformly present on the toner particle surfaces, without being buried in toner particle surfaces. In order for the hydrophobic fine titanium oxide particles to have preferable abrasive properties, it is very effective to use the hydrophobic fine titanium oxide particles having a number average particle diameter of 1 to 100 nm and showing the specific ratio of maximum intensity to minimum intensity in the X-ray diffraction of hydrophobic fine titanium oxide particles.

In the present invention, the hydrophobic fine titanium oxide particles may respectively have a hydrophobicity in the range of from 40 to 90%.

If the hydrophobic fine titanium oxide particles have a hydrophobicity lower than 40%, the quantity of triboelectricity of toner tends to lower, which lowers especially in an environment of high humidity, to tend to cause toner scatter, fog and image deterioration. If the hydrophobic fine titanium oxide particles have a hydrophobicity higher than 90%, it is difficult to control any preferable charging of the hydrophobic fine titanium oxide particles themselves, tending to cause charge-up of toner especially in an environment of low humidity.

The hydrophobicizing agent may include coupling agents such as silane coupling agents, titanate coupling agents, aluminum coupling agents and zircoaluminate coupling agents.

Stated specifically, for example, the silane coupling agents may preferably be those represented by the formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative of any of these; and n represents an integer of 1 to 3.

They may include, for example, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

For the treatment, the coupling agent may preferably be used in an amount of from 1 to 60 parts by weight, and more preferably from 3 to 50 parts by weight, based on 100 parts by weight of the fine titanium oxide particles.

In the present invention, the coupling agent may more preferably be an alkylalkoxysilane coupling agent represented by the formula:

$$C_nH_{2n+1}—Si—(OC_mH_{2m+1})_3$$

wherein n represents an integer of 4 to 12 and m represents an integer of 1 to 3.

In the above alkylalkoxysilane coupling agent, if n in the formula is smaller than 4, the treatment can be made with ease but the hydrophobicity may lower undesirably. If n is larger than 12, a satisfactory hydrophobicity can be achieved but the coalescence of fine titanium oxide particles may much occur, resulting in a lowering of fluidity-providing performance.

If m is larger than 3, the reactivity of the alkylalkoxysilane coupling agent may lower to make the particles well hydrophobic with difficulty. In the alkylalkoxysilane coupling agent, the n may preferably be 4 to 8, and m, 1 or 2.

For the treatment, the alkylalkoxysilane coupling agent may preferably be used in an amount of from 1 to 60 parts by weight, and more preferably from 3 to 50 parts by weight, based on 100 parts by weight of the fine titanium oxide particles.

The fine titanium oxide particles may be made hydrophobic using one kind of hydrophobicizing agent, or two or more kinds of hydrophobicizing agents. For example, the fine titanium oxide particles may be made hydrophobic using one kind of coupling agent alone, or using two kinds of coupling agents simultaneously, or may be made hydrophobic using one coupling agent and thereafter may be further made hydrophobic using another coupling agent.

In the present invention, to make the fine titanium oxide particles hydrophobic using the hydrophobicizing agent, the following methods may be employed. However, the present invention is by no means limited to these methods.

(a) As a method of making hydrophobic treatment by a wet process, in a dispersion of fine metatitanic acid particles or fine titanium oxide particles used in a stated quantity, a hydrophobicizing agent, a dilute solution thereof or a mixture thereof is added in a stated quantity while thoroughly mixing and stirring them by a mechanical means, followed by further mixing and stirring so as not to cause coalescence of particles. After they have been well mixed and stirred, the product obtained is dried, followed by disintegration.

(b) A method of making hydrophobic treatment by a dry process, first, fine titanium oxide particles used in a stated quantity are agitated using a machine such as a blender, during which a hydrophobicizing agent, a dilute solution thereof or a mixture thereof is dropwise added or spray-added in a stated quantity, followed by thorough mixing and agitation. Thereafter, a hydrophobicizing agent, a dilute solution thereof or a mixture thereof is further added in a stated quantity, followed by further thorough mixing and stirring. Next, the mixture obtained is heated and then dried. Thereafter, the dried product obtained is agitated using a machine such as a blender to make disintegration.

In particular, a method may be used in which the alkylalkoxysilane coupling agent is added in an aqueous medium containing fine metatitanic acid particles dispersed to form a slurry, to make the fine metatitanic acid particles hydrophobic, followed by heating to form hydrophobic fine titanium oxide particles having an intensity ratio Ia/Ib of from 5.0 to 12.0. This method is preferable because the particles can be made uniformly hydrophobic on the level of primary particles and any coarse agglomerates of hydrophobic fine titanium oxide particles may hardly be formed.

The hydrophobic fine titanium oxide particles used in the present invention may preferably have a volume resistivity of $10^8$ Ω. cm or above.

It is suitable for the hydrophobic fine titanium oxide particles to be in a content of from 0.1 to 5 parts by weight based on 100 parts by weight of the toner particles. If they are in a content less than 0.1 part by weight, their addition can be less effective, resulting in a low fluidity of toner. If they are in a content more than 5 parts by weight, the fluidity of toner may be too high, and in reverse the uniform charging may be hindered.

Particle size distribution of the toner will be described below.

As a result of extensive studies on image density, highlight reproducibility (halftone reproducibility) and fine-line reproducibility, the toner to which the hydrophobic fine titanium oxide particles have been externally added may preferably have a weight average particle diameter of from 3 to 9 μm. In addition, toner particles with diameters of 4 μm or smaller greatly contribute to the improvement especially in highlight reproducibility.

If the toner has a weight average particle diameter larger than 9 μm, the toner is short of the toner particles that can fundamentally contribute to the achievement of higher image quality, and is hard to faithfully adhere to fine electrostatic images formed on the photosensitive drum, resulting in a poor highlight reproducibility and also a low resolution. Also, too much over-application of toner on the electrostatic image may occur to tend to cause an increase in toner consumption.

If on the other hand the toner has a weight average particle diameter smaller than 3 μm, the toner tends to have a high charge quantity per unit weight to tend to cause an insufficient image density especially in an environment of low temperature and low humidity. In particular, such a toner is unsuited for the development of images having a high image area percentage as exemplified by graphic images.

In addition, if the toner has a weight average particle diameter smaller than 3 μm, its contact charging with the carrier can not be made smoothly to cause an increase in toner not well chargeable, resulting in conspicuous toner scatter on non-image areas and fog. To cope with such a difficulty, one may contemplate making the carrier diameter smaller in order to gain the specific surface area of the carrier. However, the toner with a weight average particle diameter smaller than 3 μm tends to also cause self-agglomeration of toner particles, so that the toner can not be uniformly blended with the carrier in a short time and tends to cause fog when the toner is continually supplied to carry out running.

The toner of the present invention may preferably have the toner particles with diameters of 4 μm or smaller in an amount of from 8 to 70% by number, and more preferably from 10 to 60% by number, of the total number of particles. If the toner particles with diameters of 4 μm or smaller are less than 8% by number, the toner is short of fine toner particles necessary for high image quality, where, in particular, effective toner particle components in the developing assembly may decrease as the toner is continually consumed as a result of copying or printing-out continuously carried out, so that the particle size distribution of toner may become ill-balanced to cause a gradual lowering of image quality.

If the toner particles with diameters of 4 μm or smaller are more than 70% by number, the agglomeration between toner particles tends to occur and the toner may often behave as toner masses, so that images formed may be rough, the resolution may lower, or electrostatic images may have a large difference in density between their edges and inner sides to tend to provide images with slightly blank areas, undesirably.

The toner of the present invention may have toner particles with diameters of 10.08 μm or larger in an amount of from 2 to 25% by volume, and preferably from 3.0 to 20.0% by volume. If such particles are more than 25% by volume, the image quality may lower and also excessive development (i.e., over-application of toner) may occur to cause an increase in toner consumption. If on the other hand they are less than 2% by volume, there is a possibility of a lowering of image characteristics because of a decrease in fluidity of toner.

In order to make the present invention much better effective, the toner may contain toner particles with diameters of 5.04 μm or smaller in an amount of from 10% by number to 90% by number, and more preferably from 15% by number to 80% by number.

In order to well handle the fine toner particles, it is great points to improve fluidity and to stabilize charging. It is difficult to form good images if either is missing.

Accordingly, in order to bring out the potentiality of the toner having the particle size distribution as described above to the full, to achieve a high resolution and a high gradation, it is preferable to use the toner with external addition of the above specific hydrophobic fine titanium oxide particles having a superior fluidity-providing performance and charging performance. The combination of the both enables formation of better images.

In general, as being made to have finer particles, toners tend to scatter from the developing assembly. Since, however, the hydrophobic fine titanium oxide particles used in the present invention have also a high charge-providing performance, both the improvement in fluidity and the stabilization of charge can be achieved.

In the present invention, the toner may also have a degree of agglomeration of from 2 to 25%, preferably from 2 to 20%, and more preferably from 2 to 15%.

If the toner has a degree of agglomeration higher than 25%, problems tend to arise such that the toner transport performance may lower when transported from the toner hopper to the developing assembly, the toner can not be well blended with the carrier and also the toner can not be well charged. Accordingly, it is hard to obtain images with a high quality level however finer the toner is made and however proper the coloring power of the toner is made. If on the other hand the toner has a degree of agglomeration lower than 2%, the toner tends to scatter from the developing assembly.

As a binder resin used in the toner particles, various material resins known as toner binder resins for electrophotography may be used.

For example, it may include polystyrene, styrene copolymers such as a styrene/butadiene copolymer and a styrene/acrylate copolymer, polyethylene, ethylene copolymers such as an ethylene/vinyl acetate copolymer and an ethylene/vinyl alcohol copolymer, phenol resins, epoxy resins, acrylphthalate resins, polyamide resins, polyester resins, and maleic acid resins.

Of these resins, the effect of the present invention can be greatest especially when polyester resins are used, which have a high negative chargeability. The polyester resins can achieve excellent fixing performance and are suited for color toners, but on the other hand have so strong a negative chargeability that charges tend to become excessive. However, the use of the hydrophobic fine titanium oxide particles used in the present invention makes the polyester resins free of such difficulties and can bring about an excellent toner.

In particular, the following polyester resin is preferred because of its sharp melt properties, which is a polyester resin obtained by co-condensation polymerization of i) a diol component comprised of a bisphenol derivative or substituted bisphenol represented by the formula:

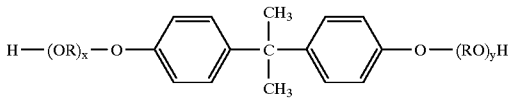

wherein R represents an ethylene group or a propylene group, and x and y each represent an integer of 1 or more, where x+y is 2 to 10 on the average; and ii) a carboxylic acid component comprising a dibasic or higher basic carboxylic acid or an acid anhydride or lower alkyl ester thereof, as exemplified by fumaric acid, maleic acid, maleic anhydride, phthalic acid, terephthalic acid, trimellitic acid and pyromellitic acid.

As a colorant, in the case of a non-magnetic toner, any known dyes or pigments may be used. For example, Phthalocyanine Blue, Indanthrene Blue, Peacock Blue Lake, Permanent Red, Lake Red, Rhodamine Lake, Hanza Yellow, Permanent Yellow and Benzidine Yellow may be used. Taking account of a sensitive reflection to light transmission properties of OHP films, the colorant may be contained in an amount not more than 12 parts by weight, and preferably from 0.5 to 9 parts by weight, based on 100 parts by weight of the binder resin.

When the toner of the present invention is used as a negatively chargeable toner, it is preferable to add a negative charge control agent to the toner particles for the purpose of stabilizing negative charging performance. Such a negative charge control agent may include organic metal compounds as exemplified by a metal compound of alkyl-substituted salicylic acid, e.g., a chromium compound, zinc compound or aluminum compound of di-tert-butylsalicylic acid.

When positively chargeable toners are produced, a charge control agent showing a positive chargeability may be used, including Nigrosine, triphenylmethane compounds, rhodamine dyes and polyvinyl pyridine.

When color toners are produced, it is preferable to use colorless or pale-color positive charge control agents having no influence on the tone of the toner.

The toner of the present invention may be optionally incorporated with additives so long as the properties of the toner are not damaged. Such additives may include, e.g., charging auxiliaries such as organic resin particles and metal oxides, lubricants such as Teflon, zinc stearate and polyvinylidene fluoride, and fixing aids as exemplified by a low-molecular weight polyethylene and a low-molecular weight polypropylene.

As a method for producing toner particles, it is possible to use a method in which component materials are well kneaded by means of a heat-kneading machine such as a heat roll, a kneader or an extruder, thereafter the kneaded product is pulverized by a mechanical means, and then the pulverized powder is classified to obtain toner particles; a method in which materials such as colorants are dispersed in a binder resin solution, followed by spray drying to produce toner particles; and a method of preparing a toner by suspension polymerization, comprising mixing prescribed materials with binder resin-constituting polymerizable monomers to obtain a monomer composition, and subjecting an emulsion suspension of the monomer composition to polymerization to produce toner particles.

In the case when the toner of the present invention is used as a two-component type developer, the carrier used may include, e.g., metals such as iron, nickel, copper, zinc, cobalt, manganese, chromium and rare earth elements, which have been surface-oxidized or unoxidized, alloys or oxides thereof, and ferrite.

Particles of the carrier may be coated with resin or the like. As a method therefor, a resin dissolved or suspended in a solvent may be coated to make it adhere to carrier particles, or the resin may be merely mixed in the form of a powder. Any conventionally known methods may be used.

The material made to adhere to the carrier particle surfaces may differ depending on toner. For example, it is suitable to use, alone or in combination, polytetrafluoroethylene, monochlorotrifluoroethylene polymer, polyvinylidene fluoride, silicone resin, polyester resin, styrene resin, acrylic resin, polyamide, polyvinyl butyral, and aminoacrylate resin. In particular, silicone resin is preferred.

The coating resin may preferably be used in an amount of from 0.1 to 30% by weight, and more preferably from 0.5 to 20% by weight, based on the weight of the carrier.

The carrier may preferably have an average particle diameter of from 10 to 100 $\mu$m, and more preferably from 20 to 70 $\mu$m.

When the two-component developer is prepared by blending the toner with the carrier, good results can be obtained when they are blended in such a proportion that gives a toner concentration of from 2 to 15% by weight, preferably from 3 to 13% by weight and more preferably from 4 to 10% by weight in the developer. If the toner is in a concentration less than 2% by weight, image density tends to lower. If it is in a concentration more than 15% by weight, fog and in-machine toner scatter may increase to shorten the lifetime of the developer.

Methods for measuring the respective characteristic values are described below.

Measurement of Ia and Ib of hydrophobic fine titanium oxide particles

The Ia and Ib of hydrophobic fine titanium oxide particles are determined by X-ray diffraction using as a ray source the K$\alpha$-rays of Cu characteristic X-rays, and the maximum intensity and the minimum intensity within the range of 2θ=20.0 to 40.0 deg are represented by Ia (Kcps) and Ib (Kcps), respectively.

As a measuring machine, for example, a high-intensity full-automatic X-ray diffraction apparatus MXP18 (manufactured by McScience Co.) may be used.

Measurement of number average particle diameter of hydrophobic fine titanium oxide particles To measure primary particle diameter, the hydrophobic fine titanium oxide particles are observed on a transmission electron microscope, and major axis particle diameters of 100 particles are measured to determine number average particle diameter. The diameters of particles on toner particles are observed on a scanning electron microscope, and major axis particle diameters of 100 particles are measured to determine number average particle diameter. The measurement is made at a magnification of from 40,000 to 60,000, and is made on particles with diameters of 0.5 nm or larger.

Measurement of BET specific surface area of hydrophobic fine titanium oxide particles The BET specific surface area of the hydrophobic fine titanium oxide particles is measured in the following way.

The BET specific surface area is determined by the BET multi-point method, using a full-automatic gas adsorption measuring device (AUTOSORB-1) manufactured by Yuasa Ionics Co., Ltd., and using nitrogen as adsorbing gas. As a pretreatment, the sample is deaerated at 50° C. for 10 hours.

Measurement of hydrophobicity

Methanol titration is an experimental means for ascertaining the hydrophobicity of inorganic fine powder whose particle surfaces have been made hydrophobic.

For evaluating the hydrophobicity of hydrophobic fine titanium oxide particles, the measurement of hydrophobicity by using methanol is carried out in the following way: 0.2 g of fine titanium oxide particles to be tested are added to 50 ml of water contained in an Erlenmeyer flask. Methanol is dropwise added from a buret. Here, the solution inside the flask is continually stirred using a magnetic stirrer. Completion of settlement of the fine titanium oxide particles is confirmed upon suspension of the whole particles in the solution. The hydrophobicity is expressed as a percentage of the methanol present in the liquid mixture of methanol and water when the settlement has reached the end point.

Measurement of particle size distribution of toner

As a measuring device, a Coulter counter Model TA-II or Coulter Multisizer II (manufactured by Coulter Electronics, Inc.) is used. As an electrolytic solution, an aqueous 1% NaCl solution is prepared using first-grade sodium chloride. For example, ISOTON R-II (trade name, Coulter Multisizer, manufactured by Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for from about 1 minute to about 3 minutes in an ultrasonic dispersion machine. The volume distribution and number distribution of the toner are calculated by measuring the volume and number of toner particles for each channel by means of the above measuring device, using an aperture of 100 μm as its aperture. Then the weight-based, weight average particle diameter (D4) determined from the volume distribution of toner particles (the middle value of each channel is used as the representative value for each channel) is determined.

As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

Measurement of degree of agglomeration

As a means for measuring the fluidity of a sample (e.g., a toner having external additives), the degree of agglomeration is used. The larger the value of the degree of agglomeration is, the poorer the fluidity of the sample is judged to be.

As a measuring apparatus, Powder Tester (manufactured by Hosokawa Micron Corporation) having a digital vibroscope (DIGIVIBRO MODEL 1332) is used.

To make the measurement, 200 mesh, 100 mesh and 60 mesh sieves are overlaid one another on a vibrating pedestal in order of mesh of smaller openings, i.e., in order of 200 mesh, 100 mesh and 60 mesh sieves so that the 60 mesh sieve is uppermost.

On the 60 mesh sieve of the sieves set in this way, a sample precisely weighed in an amount of 5 g is placed, the input voltage applied to the vibrating pedestal is set to 21.7 V and the value of displacement of the digital vibroscope is set to 0.130, where the vibrational amplitude of the vibrating pedestal is so adjusted as to be within the range of 60 to 90 μm (rheostat gauge: about 2.5), and the sieves are vibrated for about 15 seconds. Then, the weight of the sample that has remained on each sieve is measured to calculate the degree of agglomeration according to the following expression:

$$\text{Degree of agglomeration (\%)}=(\text{Sample weight on 60 mesh sieve}/5\text{ g})\times 100+(\text{sample weight on 100 mesh sieve}/5\text{ g})\times 100\times 3/5+(\text{sample weight on 200 mesh sieve}/5\text{ g})\times 100\times 1/5$$

The sample used is a sample having been left to stand in an environment of 23° C. and 60%RH for about 12 hours. The measurement is made in an environment of 23° C. and 60%RH.

An example of a developing assembly used when development with a non-magnetic one-component toner is performed using the toner of the present invention will be described below. The example is by no means limited to this.

Figure 2:
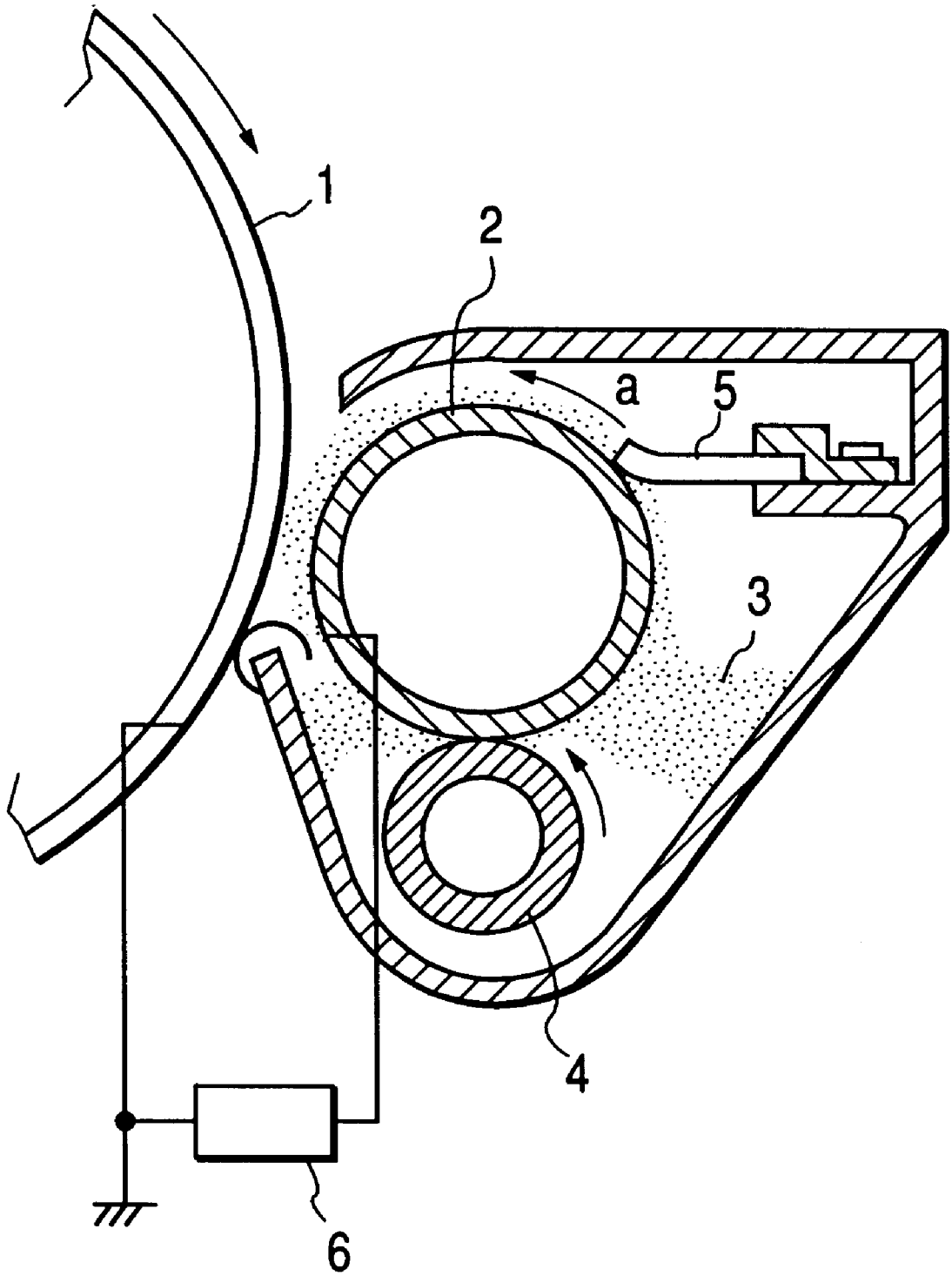
FIG. 2 is a schematic illustration showing a specific example of a developing assembly in which a non-magnetic one-component developer (toner) is used.

FIG. 2 illustrates an assembly for developing an electrostatic image formed on an electrostatic image bearing member 1. On the electrostatic image bearing member 1, the electrostatic image is formed by an electrophotographic processing means or an electrostatic recording means (not shown). A toner carrying member 2 comprises a non-magnetic sleeve formed of aluminum or stainless steel. A non-magnetic one-component color toner is reserved in a hopper 3 and is fed onto the toner carrying member 2 by a feed roller 4. The feed roller 4 also scrapes off the toner remaining on the toner carrying member 2 after development. The toner fed onto the toner carrying member 2 is coated thereon by a toner coating blade 5 in a uniform and thin layer. It is effective for the blade to be brought into touch with the toner carrying member 2 at a pressure of 3 to 250 g/cm, and preferably from 10 to 120 g/cm, as a linear pressure in the sleeve generatrix direction of the toner carrying member 2. If the touch pressure is smaller than 3 g/cm, it is difficult to uniformly coat the toner and the toner may have a broad charge quantity distribution, causing fog or toner scatter. If the touch pressure is greater than 250 g/cm, a great pressure is applied to the toner to tend to cause agglomeration between toner particles or pulverization, thus such a pressure is not preferable. Controlling the touch pressure at 3 to 250 g/cm makes it possible to well loosen agglomerates of toner with small particle diameters, and enables instantaneous rise of the quantity of triboelectricity of toner. The toner coating blade 5 may be made of a material of triboelectric series suited for electrostatically charging the toner to the desired polarity. Use of such a blade is preferred.

The toner coating blade may preferably be formed of silicone rubber, urethane rubber or styrene-butadiene rubber. Use of a conductive rubber is preferred because the toner can be prevented from triboelectrically charged in excess. The surface of the blade 5 may also be optionally coated. Especially when used as a negatively chargeable toner, the blade may preferably be coated with a positively chargeable resin such as polyamide resin.

In the system in which the toner is coated in thin layer on the toner carrying member 2 by means of the blade 5, for the purpose of achieving a good image density, it is preferable to make the thickness of the toner layer on the toner carrying member 2 smaller than the gap length at which the toner carrying member 2 faces the electrostatic image bearing member 1, and to apply an alternating electric field to the gap. The alternating electric field or a development bias formed by superposing a DC electric field on an alternating electric field may be applied across the toner carrying member 2 and the electrostatic image bearing member 1 through a bias power source 6 shown in FIG. 2, whereby the toner can readily move from the surface of the toner carrying member 2 to the surface of the electrostatic image bearing member 1 and images with a much higher image quality can be obtained.

An image forming apparatus that can preferably carry out the full-color image forming method using the toner of the present invention will be described below with reference to FIG. 3.

Figure 3:
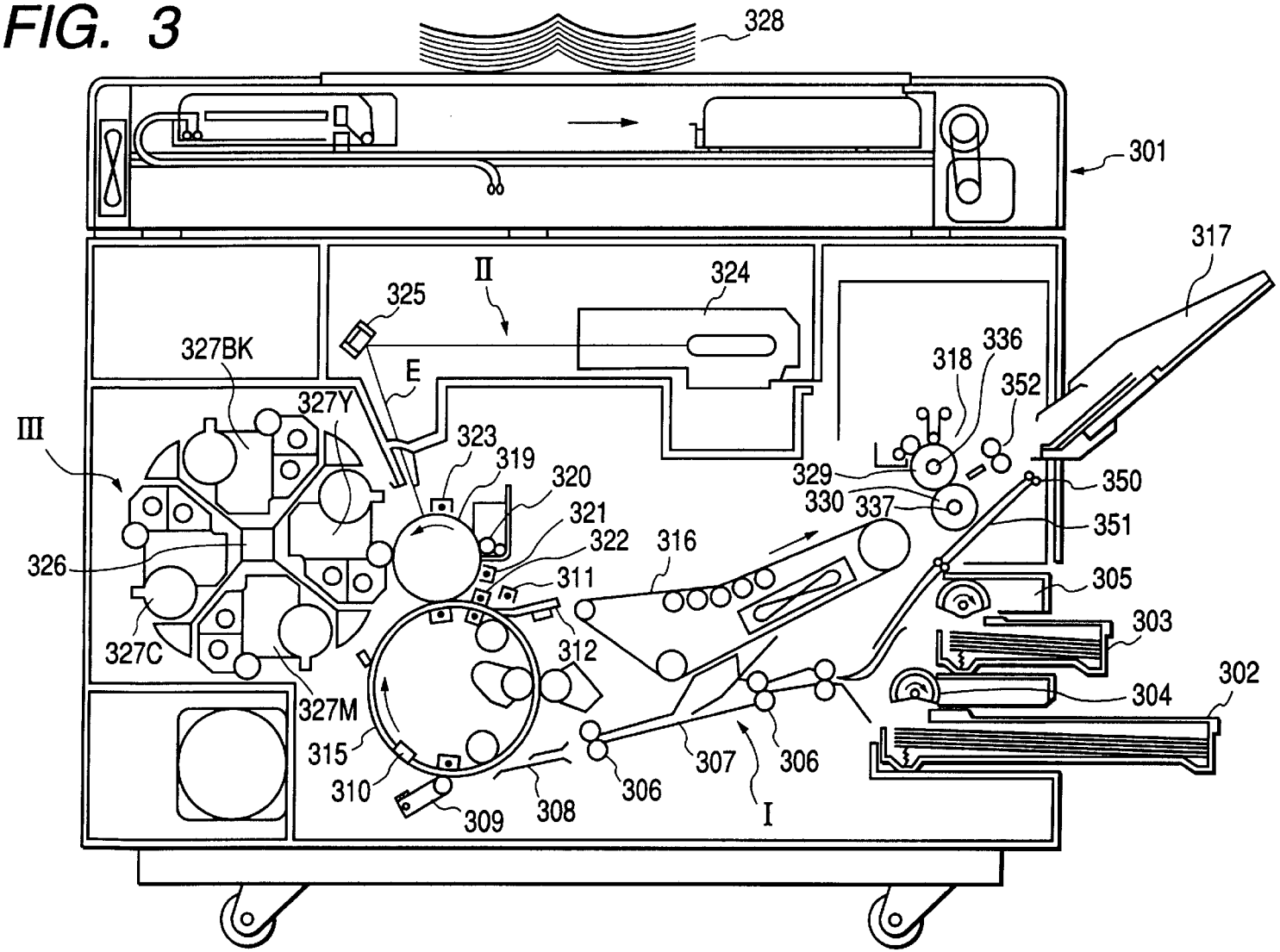
FIG. 3 is a schematic illustration showing a specific example of a full-color image forming apparatus making use of a two-component developer.

FIG. 3 schematically illustrates a color electrophotographic apparatus, which is roughly grouped into a transfer medium transport system I so provided as to extend from the right side (the right side in FIG. 3) of the main body 301 of the apparatus to substantially the middle of the main body 301 of the apparatus, an electrostatic image forming zone II provided in substantially the middle of the main body 301 of the apparatus and in proximity to a transfer drum 315 constituting the transfer medium transport system I, and a developing means, i.e., a rotary developing unit III, provided in proximity to the electrostatic image forming zone II.

The transfer medium transport system I described above is constructed in the following way. It has openings formed on the right wall (the right side in FIG. 3) of the main body 301 of the apparatus, and is provided with transfer medium feeding trays 302 and 303 detachable through the openings in the manner that they partly extend toward the outside of the apparatus. Paper feed rollers 304 and 305 are provided almost directly above the trays 302 and 303, respectively, and another paper feed roller 306 and paper guides 307 and 308 are provided in the manner that the paper feed rollers 304 and 305 can be associated with the transfer drum 315 provided on the left side and rotatable in the direction of an arrow. A contacting roller 309, a gripper 310, a transfer medium separating corona assembly 311 and a separating claw 312 are sequentially provided in the vicinity of the periphery of the transfer drum 315 from the upstream side to the downstream side in the direction of its rotation.

A transfer corona assembly 313 and a transfer medium separating corona assembly 314 are provided inside the periphery of the transfer drum 315. A transfer sheet (not shown) formed of a polymer such as polyvinylidene fluoride is stuck to the part where transfer mediums on the transfer drum 315 wind around, and the transfer mediums are electrostatically brought into close contact with the surface of the transfer sheet. A delivery belt means 316 is provided in proximity to the separating claw 312 at the right upper part of the transfer drum 315, and a fixing assembly 318 is provided at the terminal (the right side) of the transfer medium transport direction of the delivery belt means 316. A output tray 317 extending to the outside of the main body 301 of the apparatus and detachable from the main body 301 thereof is provided more downstream in the transport direction than the fixing assembly 318.

The electrostatic image forming zone II is constructed as described below. As an electrostatic image bearing member, a photosensitive drum 319 (e.g. an OPC photosensitive drum) rotatable in the direction of an arrow in FIG. 3 is provided in the manner that its periphery comes into contact with the periphery of the transfer drum 315. Above the photosensitive drum 319 and in the vicinity of the periphery thereof, a residual charge eliminating corona assembly 320, a cleaning means 321 and a primary corona assembly 323 are sequentially provided from the upstream side to the down stream side in the direction of rotation of the photosensitive drum 319. An imagewise exposure means 324 such as a laser beam scanner to form an electrostatic image on the periphery of the photosensitive drum 319, and an imagewise exposing light reflecting means 325 such as a polygon mirror are also provided.

The rotary developing unit III is constructed in the following way. It comprises a rotatable housing (hereinafter "rotating support") 326 provided at the position facing the periphery of the photosensitive drum 319. In the rotating support 326, four kinds of developing assemblies are independently mounted and are so constructed that electrostatic images formed on the periphery of the photosensitive drum 319 can be converted into visible images (i.e., developed). The four kinds of developing assemblies comprise a yellow developing assembly 327Y, a magenta developing assembly 327M, a cyan developing assembly 327C and a black developing assembly 327BK, respectively.

The sequence of the whole image forming apparatus constructed as described above will be described by giving an example of full-color mode image formation. With the rotation of the above photosensitive drum 319 in the direction of the arrow in FIG. 3, a photosensitive material on the photosensitive drum 319 is electrostatically charged by means of the primary corona assembly 323. In the apparatus shown in FIG. 3, each component part is operated at a speed (hereinafter "process speed") of 100 mm/sec or higher, e.g., 130 to 250 mm/sec. Upon the electrostatic charging on the photosensitive drum 319 by means of the primary corona assembly 323, imagewise exposure is carried out using laser light E modulated by yellow image signals of an original 328, so that an electrostatic image is formed on the photosensitive drum 319, and then the electrostatic image is developed by means of the yellow developing assembly 327Y previously set stationary at a developing position by the rotation of the rotating support 326. Thus, a yellow toner image is formed.

The transfer medium transported through the paper feed guide 307, paper feed roller 306 and paper feed guide 308 is held fast by the gripper 310 at a given timing, and is electrostatically wound around the transfer drum 315 by means of the contacting roller 309 and an electrode set opposingly to the contacting roller 309. The transfer drum 315 is rotated in the direction of the arrow in FIG. 3 in synchronization with the photosensitive drum 319. The yellow toner image formed by the development with the yellow developing assembly 327Y is transferred to the transfer medium by means of the transfer corona assembly 313 at the portion where the periphery of the photosensitive drum 319 and the periphery of the transfer drum 315 come into contact with each other. The transfer drum 315 is continued rotating without stop, and stands ready for a next color (magenta as viewed in FIG. 3).

The photosensitive drum 319 is destaticized by means of the residual charge eliminating corona assembly 320, and is cleaned through a cleaning blade as the cleaning means 321. Thereafter, it is again electrostatically charged by means of the primary corona assembly 323, and is subjected to imagewise exposure according to the next magenta image signals, where an electrostatic image is formed. The above rotary developing unit is rotated while the electrostatic image is formed on the photosensitive drum 319 according to the magenta image signals as a result of the imagewise exposure, until the magenta developing assembly 327M is set stationary at the above given developing position, where the development is carried out using a given magenta toner. Subsequently, the process as described above is also carried out for a cyan color and a black color each. After transfer steps corresponding to the four colors have been completed, a four-color visible image formed on the transfer medium is destaticized by the corona assemblies 322 and 314, and the transfer medium held by the gripper 310 is released therefrom. At the same time, the transfer medium is separated from the transfer drum 315 by means of the separating claw 312, and then delivered to the fixing assembly 318 over the delivery belt 316, where the image is fixed by the action of heat and pressure. Thus, the sequence of full-color print is completed and the desired full-color print image is form ed on one side of the transfer medium.

Here, the fixing in the fixing assembly 318 is operated at a speed (e.g., 90 mm/sec.) lower than the main-body process speed (e.g., 160 mm/sec.). This is because the heat must be applied to the toner in a sufficient quantity when the unfixed images formed of two to four toner layers superimposed one another are melt-mixed. Thus, the images are fixed at a speed lower than the development speed so th at the heat can be applied to the toners in a large quantity.

EXAMPLES

Production examples and working examples concerning the present invention will be given below. The present invention is by no means limited to these only.

Fine Titanium Oxide Particle

Production Example 1

An ilmenite ore containing 50% by weight of components corresponding to $TiO_2$ was used as a starting material. This material was dried at 150° C. for 2 hours, and thereafter sulfuric acid was added to dissolve the dried material to obtain an aqueous $TiOSO_4$ solution. This solution was concentrated and $TiOSO_4$ was hydrolyzed at 120° C. to obtain a slurry of $TiO(OH)_2$ containing impurities. This slurry was repeatedly washed with water at pH 5 to 6, to thoroughly remove the sulfuric acid, $FeSO_4$ and impurities. Thus, a slurry of high-purity metatitanic acid [$TiO(OH)_2$] was obtained.

The pH of this slurry of metatitanic acid was adjusted to 8 to 9, and the metatitanic acid was well wet-pulverized using a ball mill. Thereafter, the temperature and pH of the slurry was adjusted to 30° C. and about pH 2, respectively, with thorough stirring. The metatitanic acid was contained in the slurry in an amount of about 6% by weight. As a hydrophobicizing agent, i-$C_4H_9$—Si—$(OCH_3)_3$ was dropwise added and mixed in an amount of 50 parts by weight as solid content based on 100 parts by weight of the metatitanic acid in the slurry while thoroughly stirring so as not to cause coalescence of particles, to carry out reaction. With further thorough stirring, the pH of the slurry was adjusted to 6.5.

The resultant slurry was filtered, dried, and thereafter treated by heating at 170° C. for 2 hours to form hydrophobic fine titanium oxide particles. Thereafter, the hydrophobic fine titanium oxide particles were repeatedly disintegrated by means of a jet mill until any agglomerates thereof became no longer present to obtain hydrophobic fine titanium oxide particles A having Ia=1.09 Kcps when 2θ=25.1 deg, Ib=0.10 Kcps when 2θ=32.2 deg, intensity ratio Ia/Ib=10.9, BET specific surface area=180 $m^2/g$, number average particle diameter=25 nm, hydrophobicity=58%. Its X-ray diffraction chart is shown in FIG. 1.

Fine Titanium Oxide Particle

Production Example 2

An titanium tetraisopropoxide was used as a starting material. Using nitrogen gas as a carrier gas, this material was fed very little by little into glass wool of a vaporizer heated to 200° C., by means of a chemical pump and was evaporated, which was then heated and decomposed at a temperature of 320° C. in the reaction vessel, followed by rapid cooling, and the product formed was collected to obtain hydrophilic and amorphous fine titanium oxide powder (1). This was fired at 300° C. for 2 hours to obtain hydrophilic and crystalline fine titanium oxide powder (2).

Next, the fine titanium oxide powder (2) was uniformly dispersed in water. Thereafter, a hydrophobicizing agent i-$C_4H_9$—Si—$(OCH_3)_3$ was dropwise added and mixed in an amount of 30 parts by weight as solid content based on 100 parts by weight of the fine titanium oxide powder while dispersing so as not to cause coalescence of particles, to make hydrophobic treatment.

Thereafter, the treated product was filtered, dried, and then heated at 120° C. for 2 hours, followed by disintegration by means of a jet mill to obtain hydrophobic fine titanium oxide particles B having Ia=1.15 Kcps when 2θ=25.7 deg, Ib=0.12 Kcps when 2θ=31.5 deg, intensity ratio Ia/Ib=9.6, BET specific surface area=115 $m^2/g$, number average particle diameter=30 nm, hydrophobicity=62%.

Fine Titanium Oxide Particle

Production Example 3

The procedure of Fine Titanium Oxide Particle Production Example 1 was repeated except for using as a hydrophobicizing agent a 1:1 mixture of i-$C_4H_9$—Si—$(OCH_3)_3$ and $C_6H_{13}$—Si—$(OCH_3)_3$. Thus, hydrophobic fine titanium oxide particles C were obtained, having Ia=1.0 Kcps when 2θ=24.9 deg, Ib=0.12 Kcps when 2θ=32.0 deg, intensity ratio Ia/Ib=8.3, BET specific surface area=130 $m^2/g$, number average particle diameter=65 nm, hydrophobicity=67%.

Fine Titanium Oxide Particle

Production Example 4

The procedure of Fine Titanium Oxide Particle Production Example 1 was repeated except that the hydrophobicizing agent was added in an amount of 20 parts by weight and the disintegration after hydrophobic treatment was repeated until any agglomerates of titanium oxide became no longer present. Thus, hydrophobic fine titanium oxide particles D were obtained, having Ia=0.8 Kcps when 2θ=25.1 deg, Ib=0.11 Kcps when 2θ=30.0 deg, intensity ratio Ia/Ib=7.3, BET specific surface area=350 $m^2/g$, number average particle diameter=23 nm, hydrophobicity=30%.

Fine Titanium Oxide Particle

Production Example 5

The procedure of Fine Titanium Oxide Particle Production Example 2 was repeated except that the hydrophobicizing agent was added in an amount of 60 parts by weight and the disintegration after hydrophobic treatment was repeated until any agglomerates of titanium oxide became no longer present. Thus, hydrophobic fine titanium oxide particles E were obtained, having Ia=1.18 Kcps when 2θ=25.7 deg, lb=0.11 Kcps when 2θ=31.4 deg, intensity ratio Ia/Ib=10.7, BET specific surface area=101 $m^2/g$, number average particle diameter=80 nm, hydrophobicity=95%.

Fine Titanium Oxide Particle

Production Example 6 (Comparative Example)

The metatitanic acid obtained in Fine Titanium Oxide Particle Production Example 1 was treated by heating at 300° C. for 5 hours, followed by thorough disintegration to obtain hydrophilic fine titanium oxide powder with anatase type crystals, having a BET specific surface area of 120 $m^2/g$ and a number average particle diameter of 100 nm.

Next, as a hydrophobicizing agent, i-$C_4H_9$—Si—$(OCH_3)_3$ was dropwise added and mixed in an amount of 20 parts by weight as solid content based on 100 parts by weight of the hydrophilic fine titanium oxide while thoroughly dispersing, to make hydrophobic treatment.

Thereafter, the treated product was filtered, dried at 120° C. for 5 hours, and then treated by heating at 170° C. for 5 hours, followed by disintegration by means of a jet mill until any agglomerates of hydrophobic fine titanium oxide particles became no longer present, to obtain hydrophobic fine titanium oxide particles F having Ia=1.83 Kcps when 2θ=25.4 deg, lb=0.11 Kcps when 2θ=29.2 deg, intensity ratio Ia/Ib=16.6, BET specific surface area=90 $m^2/g$, number average particle diameter=130 nm, hydrophobicity=55%.

Fine Titanium Oxide Particle

Production Example 7 (Comparative Example)

The metatitanic acid obtained in Fine Titanium Oxide Particle Production Example 1 was treated by heating at 150° C. for 2 hours, followed by thorough disintegration to obtain hydrophilic fine titanium oxide powder with hydrophilic anatase type crystals, having a BET specific surface area of 135 $m^2/g$ and a number average particle diameter of 90 nm.

Next, as a hydrophobicizing agent, i-$C_4H_9$—Si—$(OCH_3)_3$ was dropwise added and mixed in an amount of 20 parts by weight as solid content based on 100 parts by weight of the hydrophilic fine titanium oxide powder while thoroughly dispersing, to make hydrophobic treatment.

Thereafter, the treated product was filtered, and treated by heating at 170° C. for 3 hours, followed by disintegration by means of a jet mill until any agglomerates of hydrophobic fine titanium oxide particles became no longer present.

Thus, hydrophobic fine titanium oxide particles G were obtained, having Ia=1.45 Kcps when 2θ=25.3 deg, Ib=0.11 Kcps when 2θ=29.4 deg, intensity ratio Ia/Ib=13.2, BET specific surface area=110 $m^2/g$, number average particle diameter=110 nm, hydrophobicity=55%.

Fine Titanium Oxide Particle

Production Example 8 (Comparative Example)

The amorphous fine titanium oxide powder (1) obtained in Fine Titanium Oxide Particle Production Example 2 was uniformly dispersed in water. Thereafter, a hydrophobicizing agent i-$C_4H_9$—Si—$(OCH_3)_3$ was dropwise added and mixed in an amount of 20 parts by weight as solid content based on 100 parts by weight of the fine titanium oxide powder while stirring, to make hydrophobic treatment.

Thereafter, the treated product was filtered, dried, and then treated by heating at 120° C., followed by disintegration by means of a Jet mill to obtain hydrophobic fine titanium oxide particles H having Ia=0.13 Kcps when 2θ=39.6 deg, Ib=0.04 Kcps when 2θ=20.6 deg, intensity ratio Ia/Ib=3.3, BET specific surface area=120 $m^2/g$, number average particle diameter=25 nm, hydrophobicity=65%.

Fine Titanium Oxide Particle

Production Example 9 (Comparative Example)

The procedure of Fine Titanium Oxide Particle Production Example 2 was repeated except that the amorphous fine titanium oxide powder (1) was fired at 800° C. for 5 hours. Thus, hydrophobic fine titanium oxide particles I with anatase type crystals were obtained, having Ia=1.81 Kcps when 2θ=25.4 deg, Ib=0.12 Kcps when 2θ=29.4 deg, intensity ratio Ia/Ib=15.1, BET specific surface area=85 $m^2/g$, number average particle diameter=60 nm, hydrophobicity=52%.

Fine Titanium Oxide Particle

Production Example 10 (Comparative Example)

100 parts by weight of fine titanium oxide powder (Titanium Oxide P25, available from Nippon Aerosil Co., Ltd.) with hydrophilic anatase type crystals and rutile type crystals mixedly present, obtained by flaming of titanium tetrachloride, were uniformly dispersed in water. Thereafter, as a hydrophobicizing agent, i-$C_4H_9$—Si—$(OCH_3)_3$ was dropwise added and mixed in an amount of 20 parts by weight as solid content while thoroughly dispersing so as not to cause coalescence of particles, to make hydrophobic treatment.

Thereafter, the treated particles were filtered, dried, and then treated by heating at 120° C. for 2 hours, followed by disintegration by means of a jet mill to obtain hydrophobic fine titanium oxide particles J having Ia=1.68 Kcps when 2θ=27.3 deg, Ib=0.12 Kcps when 2θ=29.2 deg, intensity ratio Ia/Ib=14, BET specific surface area=65 $m^2/g$, number average particle diameter=55 nm, hydrophobicity=50%.

Characteristic values of the above hydrophobic fine titanium oxide particles are shown in Table 1.

TABLE 1

| Titanium oxide | Maximum intensity Ia (Kcps) | Maximum intensity position 2θ (deg) | Minimum intensity Ib (Kcps) | Minimum intensity position 2θ (deg) | Ia/Ib | Number average particle diameter (nm) | BET specific surface area ($m^2/g$) | Hydro-phobicity (%) |
|---|---|---|---|---|---|---|---|---|
| A | 1.09 | 25.1 | 0.10 | 32.2 | 10.9 | 25 | 180 | 58 |
| B | 1.15 | 25.7 | 0.12 | 31.5 | 9.6 | 30 | 115 | 62 |
| C | 1.0 | 24.9 | 0.12 | 32.0 | 8.3 | 65 | 130 | 67 |
| D | 0.8 | 25.1 | 0.11 | 30.0 | 7.3 | 23 | 350 | 30 |
| E | 1.18 | 25.7 | 0.11 | 31.4 | 10.7 | 80 | 101 | 95 |
| F (Cp) | 1.83 | 25.4 | 0.11 | 29.2 | 16.6 | 130 | 90 | 55 |
| G (Cp) | 1.45 | 25.3 | 0.11 | 29.4 | 13.2 | 110 | 110 | 55 |
| H (Cp) | 0.13 | 39.6 | 0.04 | 20.6 | 3.3 | 25 | 120 | 65 |
| I (Cp) | 1.81 | 25.4 | 0.12 | 29.4 | 15.1 | 60 | 85 | 52 |
| J (Cp) | 1.68 | 27.3 | 0.12 | 29.2 | 14 | 55 | 65 | 50 |

Cp: Comparative Example

Example 1

Polyester resin obtained by condensation of propoxylated bisphenol and fumaric acid (binder resin; weight average molecular weight: 25,000) 100 parts Phthalocyanine pigment (cyan colorant) 4 parts Chromium complex of di-tert-butylsalicylic acid (negative charge control agent) 4 parts The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The finely pulverized product thus obtained was classified to obtain negatively triboelectrically chargeable non-magnetic cyan toner particles having a weight average particle diameter of 6.0 μm (particles with diameters of 4.0 μm or smaller: 21.3% by number; particles with diameters of 5.04 μm or smaller: 48.5% by number; particles with diameters of 8.0 μm or larger: 6.1% by volume; particles with diameters of 10.08 μm or larger: 0.6% by volume).

100 parts by weight of the cyan toner particles and 1.5 parts by weight of the hydrophobic fine titanium oxide particles A were mixed using a Henschel mixer to obtain a non-magnetic cyan toner. The cyan toner thus obtained had substantially the same particle size distribution as the cyan toner particles.

The above cyan toner and a silicone-resin-coated ferrite carrier were blended in a toner concentration of 6% to produce a two-component developer. Using this developer and a full-color copying machine CLC-800 (manufactured by CANON INC.; monochromatic mode, A4-size 28 sheets/min), constituted similarly to the image forming apparatus shown in FIG. 3, an original having an image area percentage of 25% was copied to reproduce images on 10,000 sheets in a monochromatic mode in an environment of high temperature and high humidity (30° C./80%RH) and in an environment of normal temperature and low humidity (23° C./5%RH).

Results obtained are shown in Table 2.

In the running test, the above two-component developer showed very small variations in image density, fog and toner charge quantity, and very good results were obtained without any problem on toner scatter after 10,000 sheet running. After the 10,000 sheet running, the OPC photosensitive drum surface was examined using a scanning electron microscope to find that neither deposits nor scratches were seen at all, showing a good surface condition.

Results of the following Examples and Comparative Example are also shown in Table 2 [Table 2(A), 2(B), 2(C)].

Example 2

A two-component developer was prepared in the same manner as in Example 1 except that the hydrophobic fine titanium oxide particles B were used, and experiments were made in the same manner as in Example 1. As a result, even after the 10,000 sheet running, the variation in toner charge quantity was small, and highly minute images having a high and stable image density, free of fog and having a superior highlight reproducibility were obtained. Toner scatter also did not occur to obtain good results.

Neither deposits nor scratches were also seen on the photosensitive drum surface examined after the running.

Example 3

A two-component developer was prepared in the same manner as in Example 1 except that the hydrophobic fine titanium oxide particles C were used, and experiments were made in the same manner as in Example 1. As a result, even after the 10,000 sheet running, the variation in toner charge quantity was small, and good images having a high and stable image density and free of fog were obtained. Toner scatter also did not occur to obtain good results. Also, neither deposits nor scratches were seen on the photosensitive drum surface examined after the running.

Since the toner of the present Example had a slightly higher degree of agglomeration, the reproducibility at highlight areas was inferior to that in Example 1 but not on the level that might come into question in practical use.

Example 4

A two-component developer was prepared in the same manner as in Example 1 except that the hydrophobic fine titanium oxide particles D were used, and experiments were made in the same manner as in Example 1. As a result, after the 10,000 sheet running, the toner charge quantity slightly lowered to slightly cause an increase in image density, and fog was also seen to slightly occur. Toner scatter in a very small quantity also occurred. These phenomena, however, were not on the level that might come into question in practical use.

Neither deposits nor scratches were also seen on the photosensitive drum surface examined after the running.

Example 5

A two-component developer was prepared in the same manner as in Example 1 except that the hydrophobic fine titanium oxide particles E were used, and experiments were made in the same manner as in Example 1. As a result, after the 10,000 sheet running, the toner charge quantity slightly increased to slightly cause a decrease in image density, but neither fog nor toner scatter occurred to obtain good results.

On the photosensitive member surface examined after the running, scratches presumably due to agglomerates of fine titanium oxide particles were seen to slightly occur, but caused no faulty images and were not on the level that might come into question in practical use.

Example 6

A two-component developer was prepared in the same manner as in Example 1 except that negatively triboelectrically chargeable non-magnetic cyan toner particles with a weight average particle diameter of 2.5 μm which were produced in the same manner as in Example 1 were used, and experiments were made in the same manner as in Example 1. As a result, in either environment, the image density slightly lowered and fog and toner scatter slightly occurred after the 10,000 sheet running, but not on the level that might come into question in practical use.

This was considered due to the cyan toner particles, having so small a weight average particle diameter that the charge quantity per unit weight increased to slightly cause a decrease in the image density. It was also presumed that, because of not so smooth contact charging with the carrier, some toner was insufficiently charged to have slightly caused the fog and toner scatter.

Example 7

A two-component developer was prepared in the same manner as in Example 1 except that negatively triboelectrically chargeable non-magnetic cyan toner particles with a weight average particle diameter of 9.5 μm which were produced in the same manner as in Example 1 were used, and experiments were made in the same manner as in Example 1. As a result, in either environment, a high image density was achieved, but the fine-line reproducibility was at a little poor level and images slightly lacking in minuteness were formed. These, however, were not on the level that might come into question in practical use.

This was considered due to the cyan toner particles, having so large a weight average particle diameter that the toner particles with diameters of 4 μm or smaller which greatly contribute to fine-line reproducibility were in a small quantity.

Example 8

Negatively triboelectrically chargeable non-magnetic magenta toner particles with a weight average particle diameter of 6 μm were produced in the same manner as in Example 1 except that the cyan colorant was replaced with a magenta colorant (a dimethylquinacridone pigment), and 100 parts by weight of the magenta toner particles thus obtained and 1.3 parts by weight of the hydrophobic fine titanium oxide particles A were mixed to obtain a non-magnetic magenta toner. Subsequently, a two-component developer was prepared in the same manner as in Example 1 and image reproduction was tested in the same manner as in Example 1 in a monochromatic mode and at a process speed of A4-size 28 sheets/min. As a result, like Example 1, good magenta images were formed, showing a good environmental stability and a good many-sheet running performance.

Example 9

Negatively triboelectrically chargeable non-magnetic yellow toner particles with a weight average particle diameter of 6 μm were produced in the same manner as in Example 1 except that the cyan colorant was replaced with a yellow colorant (C.I. Pigment Yellow 17), and 100 parts by weight of the yellow toner particles thus obtained and 1.0 part by weight of the hydrophobic fine titanium oxide particles A were mixed to obtain a non-magnetic yellow toner. Subsequently, a two-component developer was prepared in the same manner as in Example 1 and image reproduction was tested in the same manner as in Example 1 in a monochromatic mode and at a process speed of A4-size 28 sheets/min. As a result, like Example 1, good yellow images were formed, showing a good environmental stability and a good many-sheet running performance.

Next, using the cyan color two-component developer prepared in Example 1, the magenta color two-component developer prepared in Example 8 and the yellow color two-component developer prepared in the present Example 8, image reproduction was tested using the full-color copying machine in a full-color mode. As a result, high-quality full-color images faithfully reproducing an original full-color image were formed.

Comparative Example 1

A two-component developer was prepared in the same manner as in Example 1 except that the hydrophobic fine titanium oxide particles F were used, and experiments were made in the same manner as in Example 1. As a result, after the 10,000 sheet running, the toner charge quantity extremely decreased and, because of a broad range of charge quantity distribution, the image density greatly increased to cause fog and toner scatter. These phenomena remarkably occurred especially in the environment of high temperature and high humidity.

The OPC photosensitive drum surface was examined after the running to find that deep scratches were seen to have been made in a large number over the whole surface. These scratches appeared as faulty images.

The hydrophobic fine titanium oxide particles F used in the present Comparative Example had a large intensity ratio Ia/Ib and contained agglomerates in a large number. Thus, when externally added to the toner particles, they achieved no sufficient fluidity of toner and also scratched the photosensitive drum surface. Also, because of the presence of fine titanium oxide particles whose surfaces were not uniformly treated with the hydrophobicizing agent, the charge quantity of the toner was not well controllable. Thus, it is considered that these factors caused the difficulties as stated above.

Comparative Example 2

A two-component developer was prepared in the same manner as in Example 1 except that the hydrophobic fine titanium oxide particles G were used, and experiments were made in the same manner as in Example 1. As a result, after the 10,000 sheet running, the toner charge quantity decreased and, because of a broadened range of charge quantity distribution, the image density increased to cause fog and toner scatter. These phenomena remarkably occurred especially in the environment of high temperature and high humidity.

The OPC photosensitive drum surface was examined after the running to find that deep scratches were seen to have been made in a large number over the whole surface. These scratches appeared as faulty images.

The hydrophobic fine titanium oxide particles G used in the present Comparative Example had undergone crystal growth because of the firing before the hydrophobic treatment, and moreover had a large intensity ratio Ia/Ib and contained agglomerates in a large number. Thus, when externally added to the toner particles, they not only achieved no sufficient fluidity of toner but also scratched the photosensitive drum surface. Also, because of the presence of fine titanium oxide particles whose surfaces were not uniformly treated with the hydrophobicizing agent, the charge quantity of the toner was not well controllable. Thus, it is considered that these factors caused the difficulties as stated above.

Comparative Example 3

A two-component developer was prepared in the same manner as in Example 1 except that the hydrophobic fine titanium oxide particles H were used, and experiments were made in the same manner as in Example 1. As a result, even after the 10,000 sheet running, the variations in toner charge quantity and image density were not on the level that might come into question in practical use. Fog and toner scatter were also seen but not on the level that might come into question in practical use.

However, when the OPC photosensitive drum surface was examined after the running, scratches were not seen but the toner was seen to have adhered on many spots. Then, the areas where the toner had adhered appeared as faulty images, which were on the level not suited for practical use.

The hydrophobic fine titanium oxide particles H used in the present Comparative Example had a small intensity ratio Ia/Ib and had no clear and high peak in X-ray diffraction, and therefore they were amorphous fine titanium oxide particles. Hence, it is considered that, since the fine titanium oxide particles had undergone no crystal growth at all, they were soft as particles and, even though they were fine particles with an average particle diameter of 25 nm, their performance to impart abrasive properties to toner was so low that the toner having adhered to the OPC photosensitive drum surface was not removed.

Comparative Example 4

A two-component developer was prepared in the same manner as in Example 1 except that the hydrophobic fine titanium oxide particles I were used, and experiments were made in the same manner as in Example 1. As a result, after the 10,000 sheet running, the toner charge quantity decreased and, because of a broadened range of charge quantity distribution, the image density increased to cause fog and toner scatter.

The OPC photosensitive drum surface was examined after the running to find that scratches were seen to have been made in a large number over the whole surface. The areas of these scratches appeared as white spots on the image.

The hydrophobic fine titanium oxide particles I used in the present Comparative Example were those prepared by making hydrophobic the fine titanium oxide powder obtained by firing at a high temperature for a long time, and hence they had a large intensity ratio Ia/Ib and a small BET specific surface area and contained agglomerates in a large number. Thus, when the hydrophobic fine titanium oxide particles I were externally added to the toner particles, no sufficient fluidity was achieved, and hence the highlight reproducibility was at a poor level and it was difficult to well control the charge quantity of toner. It is also understood that the agglomerates of the fine titanium oxide particles scratched the OPC photosensitive drum surface.

Comparative Example 5

A two-component developer was prepared in the same manner as in Example 1 except that the hydrophobic fine titanium oxide particles J were used, and experiments were made in the same manner as in Example 1. As a result, after the 10,000 sheet running, the toner charge quantity decreased and, because of a broadened range of charge quantity distribution, the image density increased to cause fog and toner scatter.

The OPC photosensitive drum surface was examined after the running to find that deep scratches were seen to have been made in a large number over the whole surface. These scratches appeared as faulty images.

The hydrophobic fine titanium oxide particles J used in the present Comparative Example contained anatase type crystals and rutile type crystals, and had so large an intensity ratio Ia/Ib that they had a small BET specific surface area and contained agglomerates in a large number. Hence, when the fine titanium oxide particles were externally added to the toner particles, they not only achieved no sufficient fluidity of toner but also scratched the OPC photosensitive drum surface. Also, the charge quantity of the toner was not well controllable. Thus, it is considered that these factors caused the difficulties as stated above.

Comparative Example 6

A two-component developer was prepared in the same manner as in Example 1 except that the hydrophobic fine titanium oxide particles A were replaced with hydrophobic fine silica particles (R972, available from Nippon Aerosil Co., Ltd.), and experiments for image formation were made in the same manner as in Example 1. Results obtained were as shown in Table 2 [Table 2(A), 2(B), 2(C)].

Evaluation methods are described below.

OHP transparency of toner:

Toner images are transferred to OHP sheets, and fixed images are light-transmitted through an overhead projector to observe projected images on the screen.

A: (Good) Images projected on the screen are sharp and also no dull colors are seen.

B: (No problem in practical use) Images projected on the screen are sharp, and dull colors are slightly seen but on the level of no problem in practical use.

C: (Problematic in practical use) Images projected on the screen lack in sharpness, and dull colors are seen which are on the level problematic in practical use.

D: (Unusable) Images projected on the screen are unsharp, and dull colors are seen which are on the level intolerable in practical use.

Fog:

Fog is measured using REFLECTOMETER MODEL TC-6DS, manufactured by Tokyo Denshoku K.K., to make evaluation. In the case of cyan toner images, an amber filter is used. Calculated according to the following expression. The smaller the numerical value is, the less the fog occurs.

Fog (reflectance) (%)=reflectance (%) of standard paper−reflectance (%) of non-image areas of a sample A: Fog is 1.0% or less and is on a good level.

B: Fog is 1.0% to 2.0% and is on the level of no problem in practical use.

C: Fog is 2.0% to 4.0% and is on the level problematic in practical use.

D: Fog is more than 4.0% and is on the level intolerable in practical use.

Toner scatter:

How the developing assembly and the surroundings of the developing assembly in the main body are contaminated with toner is examined.

A: The developing assembly and the surroundings of the developing assembly in the main body are seen to be not contaminated with toner at all.

B: The developing assembly is seen to be contaminated with a very small quantity of toner, but on the level of no problem in practical use.

C: The developing assembly and the surroundings of the developing assembly in the main body are seen to be contaminated with toner on the level problematic in practical use.

D: The developing assembly and the surroundings of the developing assembly in the main body are seen to be greatly contaminated with toner, exercising a bad influence on the function of the main body, which are on the level intolerable in practical use.

Highlight reproducibility:

Images with a Macbeth image density of 0.3 to 0.6 are outputted, and the uniformity of density and extent of coarseness are visually evaluated.

A: Good output images with an excellent uniformity of image density.

B: Images slightly lack in uniformity of image density, but on the level of no problem in practical use.

C: Images have a poor uniformity of image density and are coarse output images, which are on the level problematic in practical use.

D: Images have a greatly poor uniformity of image density and are coarse output images, which are on the level intolerable in practical use.

Condition of photosensitive drum surface:

After the 10,000 sheet running, the photosensitive drum surface is observed at 30 spots using a scanning electron microscope.

A: Deposits of toner or the like and scratches are not seen.

B: Deposits of toner or the like and scratches are seen at few spots but in such an extent that they do not appear as faulty images, and are on the level of no problem in practical use.

C: Deposits of toner or the like and scratches are seen at tens of spots, appear as faulty images, and are on the level problematic in practical use.

D: Deposits of toner or the like and scratches are seen in a large number, appear as seriously faulty images, and are on the level intolerable in practical use.

TABLE 2(A)

| | Toner | | | High temperature/high humidity environment (30° C./80% RH) | | | | |
|---|---|---|---|---|---|---|---|---|
| | Hydrophobic titanium oxide | Degree of agglomeration | OHP transparency | Macbeth image density | Fog | Toner scatter | Highlight reproducibility | Photosensitive drum surface condition |
| Example: | | | | | | | | |
| 1 | A | 9 | A | 1.78 *1 | A | A | A | A |
| 2 | B | 11 | A | 1.76 *1 | A | A | A | A |
| 3 | C | 25 | A | 1.75 *1 | A | A | B | A |
| 4 | D | 10 | A | 1.60→1.73 | B | B | B | A |
| 5 | E | 32 | A | 1.60→1.51 | A | A | B | B |
| 6 | A | 40 | A | 1.51→1.42 | B | B | B | B |
| 7 | A | 7 | A | 1.91 *1 | A | A | B | B |
| 8 | A | 11 | A | 1.76 *1 | A | A | A | A |
| 9 | A | 13 | A | 1.73 *1 | A | A | A | A |
| Comparative Example: | | | | | | | | |
| 1 | F | 45 | B | 1.60→1.93 | D | D | D | D: deep scratched |
| 2 | G | 35 | B | 1.59→1.85 | C | C | C | D: deep scratched |
| 3 | H | 16 | A | 1.55→1.65 | B | B | B | D: toner adhered |
| 4 | I | 35 | C | 1.62→1.90 | C | C | C | D: deep scratched |
| 5 | J | 39 | C | 1.61→1.88 | C | C | C | D: deep scratched |
| 6 | Hydrophobic silica | 31 | C | 1.60→1.32 | C | C | C | D: toner adhered |

*1: stably shifted

TABLE 2(B)

| | Normal temperature/low humidity environment (23° C./5% RH) | | | | |
|---|---|---|---|---|---|
| Hydrophobic titanium oxide | Macbeth image density | Fog | Toner scatter | Highlight reproducibility | Photosensitive drum surface condition |
| Example: | | | | | |
| 1 A | 1.69 *1 | A | A | A | A |
| 2 B | 1.64 *1 | A | A | A | A |
| 3 C | 1.63 *1 | A | A | B | A |

TABLE 2(B)-continued

| | | Normal temperature/low humidity environment (23° C./5% RH) | | | | |
|---|---|---|---|---|---|---|
| | Hydrophobic titanium oxide | Macbeth image density | Fog | Toner scatter | Highlight reproducibility | Photosensitive drum surface condition |
| 4 | D | 1.49→1.57 | B | B | B | A |
| 5 | E | 1.49→1.39 | A | A | B | B |
| 6 | A | 1.41→1.30 | B | B | B | B |
| 7 | A | 1.75 *1 | A | A | B | A |
| 8 | A | 1.68 *1 | A | A | A | A |
| 9 | A | 1.66 *1 | A | A | A | A |
| Comparative Example: | | | | | | |
| 1 | F | 1.49→1.85 | C | C | D | D: deep scratched |
| 2 | G | 1.45→1.75 | C | C | C | D: deep scratched |
| 3 | H | 1.41→1.51 | B | B | B | D: toner adhered |
| 4 | I | 1.43→1.70 | C | C | C | D: deep scratched |
| 5 | J | 1.45→1.77 | C | C | C | D: deep scratched |
| 6 | Hydrophobic silica | 1.40→1.00 | C | C | C | D: toner adhered |

*1: stably shifted

TABLE 2(C)

| | | Normal temperature/normal humidity environment (23° C./60% RH) | | | | |
|---|---|---|---|---|---|---|
| | Hydrophobic titanium oxide | Macbeth image density | Fog | Toner scatter | Highlight reproducibility | Photosensitive drum surface condition |
| Example: | | | | | | |
| 1 | A | 1.74 *1 | A | A | A | A |
| 2 | B | 1.69 *1 | A | A | A | A |
| 3 | C | 1.65 *1 | A | A | B | A |
| 4 | D | 1.55→1.65 | B | B | B | A |
| 5 | E | 1.56→1.48 | A | A | B | B |
| 6 | A | 1.44→1.35 | B | B | B | B |
| 7 | A | 1.83 *1 | A | A | B | B |
| 8 | A | 1.72 *1 | A | A | A | A |
| 9 | A | 1.71 *1 | A | A | A | A |
| Comparative Example: | | | | | | |
| 1 | F | 1.55→1.88 | D | D | D | D: deep scratched |
| 2 | G | 1.53→1.81 | C | C | C | D: deep scratched |
| 3 | H | 1.48→1.59 | B | B | B | D: toner adhered |
| 4 | I | 1.51→1.82 | C | C | C | D: deep scratched |
| 5 | J | 1.50→1.81 | C | C | C | D: deep scratched |
| 6 | Hydrophobic silica | 1.53→1.15 | C | C | C | D: toner adhered |

*1: stably shifted

What is claimed is:

1. A toner for developing an electrostatic image, comprising toner particles and hydrophobic fine titanium oxide particles, wherein;

said hydrophobic fine titanium oxide particles have, in X-ray diffraction, an intensity ratio Ia/Ib of $5.0 \leqq Ia/Ib \leqq 12.0$ which is a ratio of maximum intensity Ia to minimum intensity Ib within the range of 2θ20.0 to 40.0 deg.

2. The toner according to claim 1, wherein said hydrophobic fine titanium oxide particles have a BET specific surface area of from 100 $m^2/g$ to 350 $m^2/g$.

3. The toner according to claim 1, wherein said hydrophobic fine titanium oxide particles have a number average particle diameter of from 1 nm to 100 nm.

4. The toner according to claim 1, wherein said hydrophobic fine titanium oxide particles have a hydrophobicity of from 40 to 90.

5. The toner according to claim 1, which has a weight average particle diameter of from 3 μm to 9 μm.

6. The toner according to claim 1, wherein, within 2θ=20.0 to 40.0 deg in the X-ray diffraction of the hydrophobic fine titanium oxide particles, the maximum intensity Ia is present at 2θ=24.0 to 26.0 deg and the minimum intensity Ib is present at 2θ=28.0 to 33.0 deg.

7. The toner according to claim 1, wherein said hydrophobic fine titanium oxide particles are treated with a silane coupling agent represented by the formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative of any of these; and n represents an integer of 1 to 3.

8. The toner according to claim 7, wherein said hydrophobic fine titanium oxide particles are treated with said silane coupling agent in an amount of from 1 part by weight to 60 parts by weight based on 100 parts by weight of fine titanium oxide particles.

9. The toner according to claim 7, wherein said hydrophobic fine titanium oxide particles are treated with said silane coupling agent in an amount of from 3 parts by weight to 50 parts by weight based on 100 parts by weight of fine titanium oxide particles.

10. The toner according to claim 1, wherein said hydrophobic fine titanium oxide particles are treated with an alkylalkoxysilane coupling agent represented by the formula:

$$C_nH_{2n+1}—Si—(OC_mH_{2m+1})_3$$

wherein n represents an integer of 4 to 12 and m represents an integer of 1 to 3.

11. The toner according to claim 10, wherein said hydrophobic fine titanium oxide particles are treated with said alkylalkoxysilane coupling agent in an amount of from 1 part by weight to 60 parts by weight based on 100 parts by weight of fine titanium oxide particles.

12. The toner according to claim 10, wherein said hydrophobic fine titanium oxide particles are treated with said alkylalkoxysilane coupling agent in an amount of from 3 parts by weight to 50 parts by weight based on 100 parts by weight of fine titanium oxide particles.

13. The toner according to claim 1, wherein said hydrophobic fine titanium oxide particles are externally added in an amount of from 0.1 part by weight to 5 parts by weight based on 100 parts by weight of the toner particles.

14. The toner according to claim 1, which contains toner particles with particle diameters of 4 $\mu$m or smaller in an amount of from 8% by number to 70% by number in terms of number distribution.

15. The toner according to claim 1, which contains toner particles with particle diameters of 4 $\mu$m or smaller in an amount of from 10% by number to 60% by number in terms of number distribution.

16. The toner according to claim 1, which contains toner particles with particle diameters of 5.04 $\mu$m or smaller in an amount of from 10% by number to 90% by number in terms of number distribution.

17. The toner according to claim 1, which contains toner particles with particle diameters of 5.04 $\mu$m or smaller in an amount of from 15% by number to 80% by number in terms of number distribution.

18. The toner according to claim 1, which contains toner particles with particle diameters of 10.08 $\mu$m or larger in an amount of from 2% by volume to 25% by volume in terms of volume distribution.

19. The toner according to claim 1, which contains toner particles with particle diameters of 10.08 $\mu$m or larger in an amount of from 3.0% by volume to 20.0% by volume in terms of volume distribution.

20. The toner according to claim 1, which has a degree of agglomeration of from 2% to 25%.

21. The toner according to claim 1, which has a degree of agglomeration of from 2% to 20%.

22. The toner according to claim 1, which has a degree of agglomeration of from 2% to 15%.

23. The toner according to claim 1, wherein said toner particles contain at least a binder resin and a colorant.

24. The toner according to claim 23, wherein said toner particles are non-magnetic color toner particles.

25. The toner according to claim 23, wherein said toner particles are non-magnetic cyan toner particles.

26. The toner according to claim 23, wherein said toner particles are non-magnetic magenta toner particles.

27. The toner according to claim 23, wherein said toner particles are non-magnetic yellow toner particles.

28. The toner according to claim 23, wherein said binder resin is a polyester resin.

29. The toner according to claim 1, wherein said hydrophobic fine titanium oxide particles are formed by adding a silane coupling agent in an aqueous medium in which metatitanic acid particles are dispersed, making the metatitanic acid particles hydrophobic, and separating from the aqueous medium the metatitanic acid particles made hydrophobic, followed by heat treatment.

30. The toner according to claim 1, wherein said hydrophobic fine titanium oxide particles have an intensity ratio Ia/Ib of 7.3 to 10.9.

* * * * *

UNITED STATES PATENT AND TRADEMARK OFFICE

CERTIFICATE OF CORRECTION

PATENT NO. : 5,922,500

DATED : July 13, 1999

INVENTOR(S) : WAKASHI IIDA ET AL.

It is certified that error appears in the above-identified patent and that said Letters Patent is hereby corrected as shown below:

ON THE TITLE PAGE [56] References Cited

FOREIGN PATENT DOCUMENTS, "42-23910 3/1987" should read --42-23910 3/1967-- and "43-24748 6/1989" should read 43-24748 6/1968.

ON THE TITLE PAGE [57] ABSTRACT

Line 4, "ration" should read --ratio--.

COLUMN 1

Line 49, "used" should read --used in--.

COLUMN 2

Line 48, "liberating" should read --liberated--; and
Line 54, "extented" should read --extended--.

COLUMN 3

Line 23, "member" should be deleted;
Line 24, "of photosensitive member" should read --of the photosensitive member's--;
Line 25, "member" should read --member's--; and
Line 28, "in respect of" should read --with respect to--.

UNITED STATES PATENT AND TRADEMARK OFFICE

CERTIFICATE OF CORRECTION

PATENT NO. : 5,922,500

DATED : July 13, 1999

INVENTOR(S) : WAKASHI IIDA ET AL.

It is certified that error appears in the above-identified patent and that said Letters Patent is hereby corrected as shown below:

COLUMN 4

Line 5, "resolutior" should read --resolution--; and
Line 28, "into" should be deleted.

COLUMN 5

Line 65, "lowers." should read --decreases--.

COLUMN 6

Line 2, "lower to" should read --decrease and so--; and
Line 25, "which titanium oxide" should read --which kinds of titanium-oxide particle compositions--.

COLUMN 8

Line 38, "lower to make---" should read --decrease, thus making it difficult to impart satisfactory hydrophobicity to the particles.--; and
Line 39, "phobic with difficulty" should be deleted.

COLUMN 9

Line 12, "make" should read --bring about--; and
Line 67, "gain" should read --increase--.

UNITED STATES PATENT AND TRADEMARK OFFICE

CERTIFICATE OF CORRECTION

PATENT NO. : 5,922,500

DATED : July 13, 1999

INVENTOR(S) : WAKASHI IIDA ET AL.

It is certified that error appears in the above-identified patent and that said Letters Patent is hereby corrected as shown below:

COLUMN 10

Line 43, "In order to well handle the fine toner particles, it is great" should read --It is necessary to control toner particle size in order--;
Line 44, "points" should be deleted; and
Line 52, "the" should be deleted.

COLUMN 11

Line 2, "finer" should read --fine--.

COLUMN 14

Line 32, "$x^3/15+$" should read --x 3/5+--.
Line 33, "$x^1/5$" should read --x 1/5--.

COLUMN 15

Line 9, "from" should read --from being--.

COLUMN 16

Line 21, "down stream" should read --downstream--.

COLUMN 17

Line 31, "formed" should read -- formed--.
Line 37, "one" should read --on one--; and
Line 39, "th at" should read --that--.

UNITED STATES PATENT AND TRADEMARK OFFICE

CERTIFICATE OF CORRECTION

PATENT NO. : 5,922,500

DATED : July 13, 1999

INVENTOR(S) : WAKASHI IIDA ET AL.

It is certified that error appears in the above-identified patent and that said Letters Patent is hereby corrected as shown below:

COLUMN 18

Line 38, "make" should read --conduct--.

COLUMN 19

Line 31, "make" should read --conduct--; and
Line 56, "make" should read --conduct--.

COLUMN 20

Line 10,"make" should read --conduct--; and
Line 15, "Jet" should read --jet--.

COLUMN 21

Line 22, "Phthalocyanine" should read --¶ Phthalocyanine--;
Line 23, "Chromium" should read --¶ Chromium--;
Line 27, "cooled," should read --cooling,--; and
Line 67, "Example" should read --Examples--.

COLUMN 26

Line 55, "expression." should read --expression,--; and
Line 56, "The" should read --the--.

UNITED STATES PATENT AND TRADEMARK OFFICE

CERTIFICATE OF CORRECTION

PATENT NO. : 5,922,500

DATED : July 13, 1999

INVENTOR(S) : WAKASHI IIDA ET AL.

It is certified that error appears in the above-identified patent and that said Letters Patent is hereby corrected as shown below:

COLUMN 29

Line 56, "2θ20.0" should read --2θ = 20.0--.

Signed and Sealed this

Fourth Day of April, 2000

*Attest:*

Q. TODD DICKINSON

*Attesting Officer*

*Director of Patents and Trademarks*